US006233907B1

(12) United States Patent
Cook, Jr. et al.

(10) Patent No.: US 6,233,907 B1
(45) Date of Patent: May 22, 2001

(54) METHOD AND APPARATUS FOR TRIGGERING OXYGEN SCAVENGING MATERIAL AS A WALL COMPONENT IN A CONTAINER

(75) Inventors: Philip H. Cook, Jr.; Michael J. Carey, both of Greer, SC (US); Jeffrey A. Thomas, White Plains, NY (US); Nathanael R. Miranda, Spartanburg, SC (US)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 09/230,595

(22) PCT Filed: Jul. 30, 1997

(86) PCT No.: PCT/US97/13369

§ 371 Date: Jun. 24, 1999

§ 102(e) Date: Jun. 24, 1999

(87) PCT Pub. No.: WO98/05571

PCT Pub. Date: Feb. 12, 1998

(51) Int. Cl.[7] ..... B65D 81/24

(52) U.S. Cl. ..... 53/400; 53/432; 53/111 RC; 252/188.28

(58) Field of Search ..... 53/432, 433, 434, 53/510, 511, 512, 400, 111 RC; 252/188.28; 426/392, 418, 124, 129, 133

(56) References Cited

U.S. PATENT DOCUMENTS

| | | | | |
|---|---|---|---|---|
| 5,021,515 | | 6/1991 | Cochran et al. . | |
| 5,089,323 | | 2/1992 | Nakae et al. . | |
| 5,211,875 | | 5/1993 | Speer et al. | 252/188.28 |
| 5,310,497 | | 5/1994 | Ve Speer et al. . | |
| 5,350,622 | | 9/1994 | Speer et al. | 425/215 |
| 5,378,428 | | 1/1995 | Inoue et al. . | |
| 5,399,289 | | 3/1995 | Speer et al. | 252/188.28 |
| 5,417,255 | * | 5/1995 | Sanfilippo et al. | 53/432 |
| 5,425,896 | | 6/1995 | Speer et al. . | |
| 5,498,364 | | 3/1996 | Speer et al. . | |
| 5,776,361 | * | 7/1998 | Katsumoto et al. | 252/188.28 |
| 5,799,463 | * | 9/1998 | Kasiba | 53/400 |
| 5,811,027 | * | 9/1998 | Speer et al. | 252/188.28 |
| 5,811,144 | * | 9/1998 | Bordeleau et al. . | |
| 5,911,910 | * | 6/1999 | Becraft et al. | 252/188.28 |

FOREIGN PATENT DOCUMENTS

| | | |
|---|---|---|
| 0 355 982 | 2/1990 | (EP) . |
| 0 451 762 A2 | 10/1991 | (EP) . |
| WO 94/12590 | 6/1994 | (WO) . |

OTHER PUBLICATIONS

Japanese Abstract Hei 5–247276; Nakamura et al.; Mar. 4, 1992; "Oxygen Barrier Resin Composition".

Japanese Abstract Hei 5–51048; Masuda et al.; Aug. 13, 1991; "Oxygen Barrier Resin Composition, Manufacturing Process and Packaging Material Thereof".

Japanese Abstract Hei 5–51049; Tomatsuri et al.; Aug. 13, 1991; "Sheet and Container Possessing Oxygen Barrier Property".

Japanese Abstract Hei 5 32277, Yasunaga, Dec. 28, 1990; "Method for Removal of Oxygen Remained in a Package and a Package Member".

* cited by examiner

*Primary Examiner*—Stephen F. Gerrity
(74) *Attorney, Agent, or Firm*—Mark B. Quatt

(57) ABSTRACT

A method for triggering an oxygen scavenging component of a container for packaging an oxygen sensitive material includes the steps of providing a container defining an internal space and having an internal oxygen scavenging component including an oxidizable organic compound, exposing the oxygen scavenging component to a source of actinic radiation, positioned within said internal space, at a wavelength, intensity, and residence time so as to provide a dose of actinic radiation sufficient to activate the oxygen scavenging component, and packaging an oxygen sensitive material in the internal space of the container whereby the oxygen scavenging component scavenges the oxygen from the internal space of the container. An apparatus and packaging system are also disclosed.

5 Claims, 2 Drawing Sheets

METHOD AND APPARATUS FOR TRIGGERING OXYGEN SCAVENGING MATERIAL AS A WALL COMPONENT IN A CONTAINER

BACKGROUND OF THE INVENTION

The invention relates generally to a method and system of packaging oxygen sensitive materials, and particularly to a method and system for triggering an oxygen scavenging component of a container for containing oxygen sensitive materials.

It is well known that limiting the exposure of oxygen sensitive products to oxygen maintains and enhances the quality and shelf life of the product. For instance, by limiting the oxygen exposure of oxygen sensitive food products in the packaging system, the quality of the food product is maintained and spoilage is reduced. In addition, such packaging also keeps the product in inventory longer, thereby reducing costs incurred from waste and having to restock. At present, commonly used packaging systems include modified atmosphere packaging (MAP) and vacuum packaging in conjunction with oxygen barrier films. In these instances, reduced oxygen environments are employed at the time of packaging, while the oxygen barrier film reduces the amount of oxygen that physically enters the package during storage.

U.S. Pat. No. 5,211,875 to Speer et al. and PCT publication WO 94/12590 disclose methods and compositions for scavenging oxygen. The "oxygen scavenger" materials disclosed by Speer et al. are compositions which consume, deplete or reduce the amount of oxygen from a given environment.

Oxygen scavenging materials are useful in MAP and barrier packaging environments. However, problems are encountered when the oxygen scavenging material is a component of the inner wall of a pre-formed container. The difficulty arises in exposing the internal oxygen scavenging component to a uniform dosage of actinic radiation so that consistent initiation of oxygen scavenging activity across the internal surface is achieved.

The need remains for an effective method of triggering the oxygen scavenging activity of an internal oxygen scavenging component of a pre-formed container.

"Trigger" and the like herein mean that process defined in U.S. Pat. No. 5,211,875, whereby oxygen scavenging is initiated by exposing a composition, film, etc. to actinic radiation having a wavelength of less than about 750 nm at an intensity of at least about 1.6 $mW/cm^2$ or an electron beam at a dose of at least about 0.2 megarads, wherein after initiation the oxygen scavenging rate is at least about 0.05 cc oxygen per day per gram of oxidizable organic compound for at least two days after oxygen scavenging is initiated. Preferred is a method offering a short "induction period" (the time that elapses, after exposing the oxygen scavenging component to a source of actinic radiation, before initiation of the oxygen scavenging activity begins) so that the oxygen scavenging component can be activated at or immediately prior to use during filling and sealing of the container with an oxygen sensitive material; a method wherein the oxygen scavenging material is substantially consistently triggered across the entire internal surface of the preformed container; a method which is simple and readily incorporated into existing packaging procedures; and a method which is readily incorporated in-line into existing packaging systems.

SUMMARY OF THE INVENTION

According to a first aspect of the invention, a method for triggering an oxygen scavenging component of a container comprises the steps of providing a container defining an internal space and having an internal oxygen scavenging component comprising an oxidizable organic compound; and exposing said oxygen scavenging component to a source of actinic radiation, positioned within said internal space, at a wavelength, intensity, and residence time so as to provide a dose of actinic radiation sufficient to activate said oxygen scavenging component.

In a second aspect of the invention, a method for packaging an oxygen sensitive material, comprises the steps of providing containers each defining an internal space and having an internal oxygen scavenging component comprising an oxidizable organic compound; positioning a source of actinic radiation in said internal space of said containers; exposing said oxygen scavenging component to a dose of actinic radiation from said source of actinic radiation so as to provide containers each having a activated oxygen scavenging component; and feeding said containers to means for filling and sealing said containers so as to provide sealed containers wherein said oxygen scavenging component scavenges oxygen from said internal space.

In a third aspect of the invention, an apparatus for triggering an oxygen scavenging component of a container comprises means for emitting actinic radiation sufficient to activate an oxygen scavenging material comprising an oxidizable organic compound; and means for positioning a container defining an internal space and having an oxygen scavenging component relative to said means for emitting so as to position said means for emitting in said internal space of said container, whereby said internal oxygen scavenging component is exposed to a substantially uniform dose of actinic radiation from said means for emitting.

In a fourth aspect of the invention, a packaging system comprises means for emitting actinic radiation; means for positioning containers, said containers having an oxygen scavenging component and defining an internal space for containing an oxygen sensitive material, relative to said means for emitting with said means for emitting in said internal space whereby said oxygen scavenging component is exposed to a dose of actinic radiation; means for filling said containers with an oxygen sensitive material and for sealing said container containing said material; and means for conveying said containers from said means for emitting to said means for filling, whereby said containers are filled and sealed and said oxygen scavenging component scavenges oxygen from said internal space.

BRIEF DESCRIPTION OF THE DRAWINGS

A detailed description of preferred embodiments of the invention follows, with reference to the attached drawings, wherein.

DETAILED DESCRIPTION

Figure 1A:
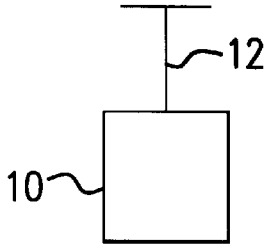
FIGS. 1A–1C are schematic illustrations of a method for triggering an internal oxygen scavenging component in accordance with the invention.

The invention relates to an improved method and apparatus for triggering an internal oxygen scavenging component of a container, especially a pre-formed rigid, semi-rigid or flexible container for containing an oxygen sensitive material. A method for packaging is also described. The method and apparatus of the present invention can advantageously be used in the packaging of a wide variety of oxygen sensitive materials including smoked and processed meats such as sliced turkey, ham, etc., vegetable products such as tomato-based sauces and products, fruit-based products such as juices, concentrates, and purees, snack foods such as potato chips, other food products, and non-food products such as cosmetics, electronic components, medical products, and the like.

A method and apparatus for triggering an internal oxygen scavenging component of a pre-formed container are provided wherein an induction period of the oxygen scavenging component, defined as the time after triggering before which the oxygen scavenging characteristics of the material are exhibited, is reduced to a period of substantially less than one day, whereby triggering, filling and sealing of containers can be incorporated as an in-line step. The oxygen scavenging component is activated through exposure to a source of actinic radiation. The oxygen scavenging component is exposed to a substantially uniform dose of actinic radiation, resulting in consistent initiation of oxygen scavenging across the internal surface of the container.

Oxygen scavenging compositions suitable for use as the oxygen scavenging component of containers to be triggered in accordance with the present invention are generally described in U.S. Pat. No. 5,211,875, U.S. Pat. No. 5,350,622, and U.S. Pat. No. 5,399,289 to Speer et al., which are hereby incorporated by reference in their entirety. As used herein, an oxygen scavenging material or component refers to a material or component having a composition which consumes, depletes or reduces the amount of oxygen from a given environment to which the material or component is exposed.

Other oxygen scavengers which can be used in connection with this invention are disclosed in PCT patent publication WO 94/12590 (Commonwealth Scientific and Industrial Research Organisation), incorporated by reference herein in its entirety. These oxygen scavengers include at least one reducible organic compound which is reduced under predetermined conditions, the reduced form of the compound being oxidizable by molecular oxygen, wherein the reduction and/or subsequent oxidation of the organic compound occurs independent of the presence of a transition metal catalyst. The reducible organic compound is preferably a quinone, a photoreducible dye, or a carbonyl compound which has absorbence in the UV spectrum.

Containers to be triggered preferably include an oxygen scavenging component containing an oxidizable organic compound and a transition metal catalyst. Optionally, the oxygen scavenging component may also include photoinitiator components, antioxidants, diluents and other additives, for example, as disclosed in U.S. Pat. No. 5,211,875.

The method and apparatus of the present invention are preferred for use with containers including oxidizable organic compounds of substituted or unsubstituted ethylenically unsaturated hydrocarbon polymers, preferably having a molecular weight of at least 1,000. More preferably, the oxidizable organic compound is selected from the group consisting of styrene/butadiene copolymers, styrene/isoprene copolymers, polybutadiene, polyisoprene, and mixtures thereof, most preferably styrene/butadiene copolymer, polybutadiene, or blends thereof.

An ethylenically unsaturated hydrocarbon and transition metal catalyst may further be combined with one or more polymeric diluents, such as thermoplastic polymers which are typically used to form film layers in plastic packaging articles. In the manufacture of certain packaging articles, well known thermosets may also be used as the polymeric diluent.

Polymers which can be used as the diluent include, but are not limited to, polyethylene terephthalate (PET), polyethylene, low or very low density polyethylene, ultra-low density polyethylene, linear low density polyethylene, polypropylene, polyvinyl chloride, polystyrene, and ethylene copolymers such as ethylene/vinyl acetate, ethylene/alkyl (meth)acrylates, ethylene/(meth)acrylic acid and ethylene/(meth)acrylic acid ionomers.

The transition metal catalyst of the oxygen scavenging component is preferably a transition metal salt of cobalt, manganese, or mixtures thereof. Other suitable transition metal catalysts are disclosed in U.S. Pat. No. 5,211,875.

It has been discovered that exposing the oxygen scavenging component to actinic radiation results in initiation of the oxygen scavenging properties of the film. Preferable actinic radiation has been found to be UV light at certain wavelength, intensity, residence time and distance from the oxygen scavenging component, which results in very short induction periods for the oxygen scavenging component so triggered. UV-C light such as ultraviolet light of germicidal wavelengths has been found to be particularly effective at triggering oxygen scavenging components, preferably at a wavelength of between 200 nm and 280 nm, most preferably at a wavelength of 254 nm.

Actinic radiation is applied in doses sufficient to activate the oxygen scavenging properties of the oxygen scavenging component of the container to be triggered. Preferably, the oxygen scavenging component is exposed to actinic radiation, preferably UV-C light at a wavelength, intensity and residence time sufficient to expose the oxygen scavenging component to a dose of at least 100 $mJ/cm^2$, more preferably at least 200 $mJ/cm_2$, and most preferably between 350 $mJ/cm^2$ and 600 $mJ/cm^2$. Actinic radiation is also preferably provided at an intensity of at least 0.8 $mW/cm^2$, more preferably between 3 $mW/cm^2$ and 10 $mW/cm^2$, and even more preferably between 3 $mW/cm^2$ and 7.5 $mW/cm^2$.

It is preferable to expose the oxygen scavenging component to a substantially uniform dose of actinic radiation. However, when the oxygen scavenging component is a wall component of a pre-formed container such as gable top cartons, aseptic cartons, composite cans, pre-formed pouches and other pre-formed containers and the like, difficulty is experienced in exposing the internal oxygen scavenging component to a uniform dose of actinic radiation.

A substantially uniform dose of actinic radiation can be provided to internal oxygen scavenging components of such containers by positioning a source of actinic radiation inside the pre-formed container for triggering. In this manner, the various interior surfaces of the container are exposed to actinic radiation at substantially uniform distances from the source, thereby resulting in the application of a substantially uniform dose of actinic radiation.

Figure 1B:
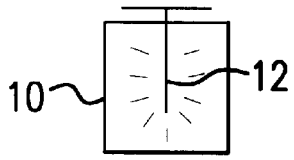
Figure 1C:
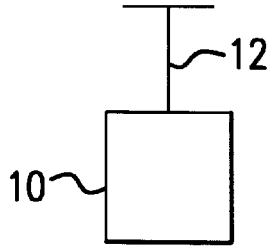

Referring to FIGS. 1A–1C, a method is schematically illustrated. In FIG. 1A, a container 10 is positioned substantially adjacent to a source 12 of actinic radiation. Referring to FIG. 1B, source 12 is positioned within container 10, preferably by positioning or displacing at least one of container 10 and source 12 relative to the other, so as to position source 12 within container 10 preferably at a substantially uniform distance from the inner walls of container 10. Once source 12 is positioned within container 10, actinic radiation emitted from source 12 provides the inner surfaces of container 10, including an oxygen scavenging component of container 10, a substantially uniform dose of actinic radiation so as to trigger the oxygen scavenging characteristics thereof. Referring to FIG. 1C, after the internal surfaces and oxygen scavenging component of container 10 have been exposed to a sufficient dose of actinic radiation, source 12 is preferably removed from container 10 to a starting position, and a new container 10 is positioned relative to source 12 for triggering.

Figure 2:
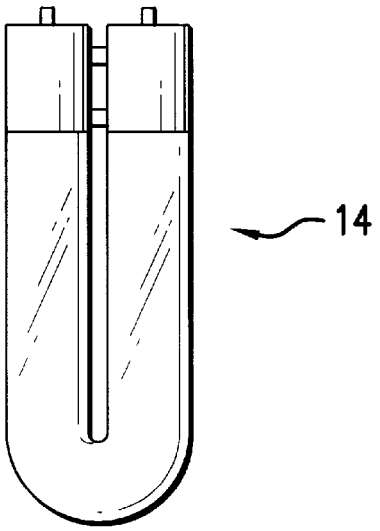
FIG. 2 is a side schematic view of a preferred embodiment of a substantially linear bulb according to the invention.

The source of actinic radiation may be any suitable bulb or other mechanism for emitting actinic radiation of the desired wavelength and intensity. It has been found particularly preferable to use bulbs for emitting ultraviolet light having a wavelength of between 200 nm and 280 nm, and even more preferably bulbs emitting light at germicidal wavelengths of 254 nm. Bulbs 14 may be provided in numerous suitable configurations. Referring to FIG. 2, a preferred configuration of bulb 14 is illustrated. As shown, bulb 14 may preferably be a substantially U-shaped tubular bulb having an overall substantially linear configuration. Bulb 14 is preferably positioned within a container to be triggered by inserting bulb 14 into the container and activating the power source for operating bulb 14 so as to emit the desired actinic radiation within the container. Bulbs 14 have a length of preferably between 8.25 and 11.25 inches.

Figure 3:
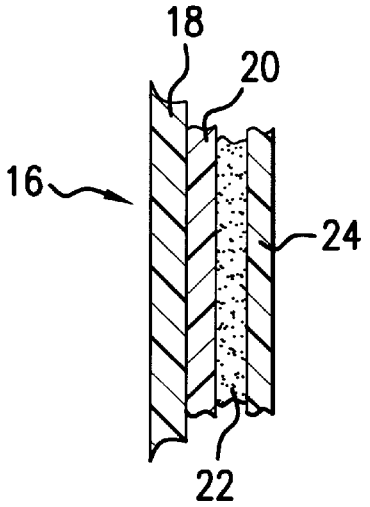
FIG. 3 is a side schematic view of a portion of a wall component of a container having an oxygen scavenging component to be triggered in accordance with the invention.

Referring to FIG. 3, a section of a wall 16 of a container 10 is illustrated. Wall 16 may include numerous layers such as an outermost paperboard substrate 18, a barrier layer 20, an oxygen scavenging layer 22, and a sealant layer 24 which, in this embodiment, forms the internal surface of the container. Oxygen scavenging layer 22 is preferably positioned substantially internally with respect to the thickness of wall 16, with any intervening layers such as sealant layer 24 preferably being substantially transparent to actinic radiation of the desired wavelength. In this manner, sealant layer 24 does not interfere with the desired exposure of oxygen scavenging component layer 22 to the desired dose of actinic radiation. Although a particular arrangement of layers is illustrated in the wall section 16 of FIG. 3, it should of course be appreciated that a wide variety of alternative layer configurations may also be present in containers having oxygen scavenger components to be triggered. For example, adhesive layers can be disposed between any of the layers shown in FIG. 3. Other functional layers can also be included. For example, a functional barrier which includes a material which scavenges by-products of the oxygen scavenging layer can be included in the film, e.g. between layers 22 and 24. Layer 24 can itself function as both a sealant and a functional barrier layer.

Wall 16 can be either monolayer or multilayer in construction, and made of any of a variety of materials, including thermoplastic and paper materials, as long as an oxygen scavenging component is present.

Oxygen scavenging components triggered in accordance with the present invention exhibit oxygen scavenging rates, depending upon the formulation and type of container, of between 1 $cc/m^2/day$ and 100 $cc/m^2/day$ at temperatures of between 4° C. and 30° C. measured four days after triggering. Thus, oxygen scavenging component of container 10 serves to scavenge oxygen from within container 10 so as to minimize oxygen exposure of the oxygen sensitive material packaged therein and thereby enhance the shelf life of the sealed container.

Figure 4:
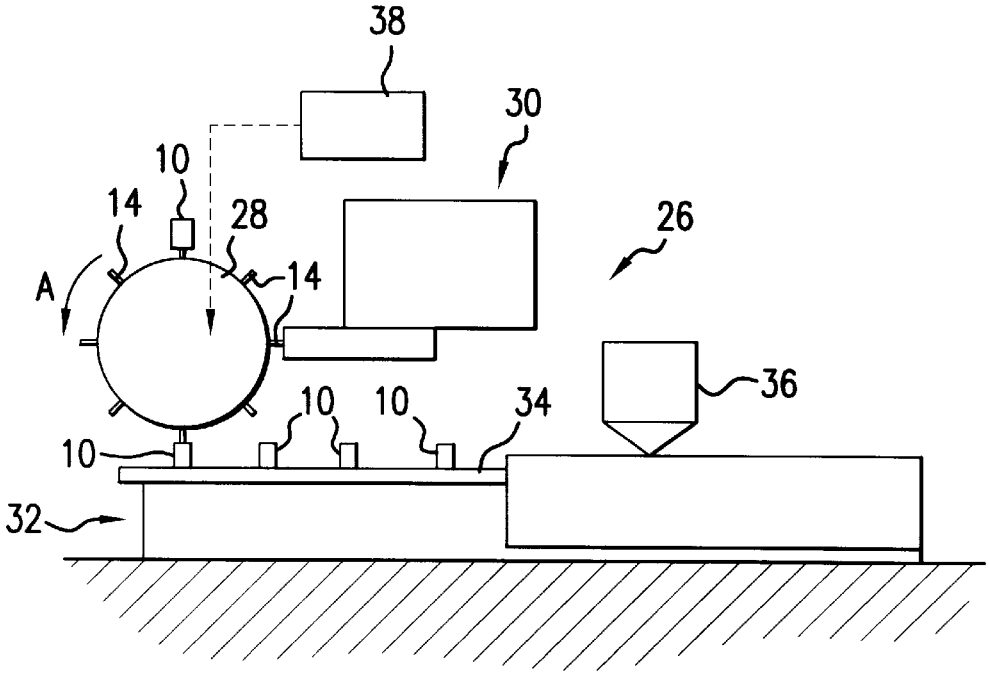
FIG. 4 is a side schematic view of an apparatus in accordance with the invention.
Figure 5:
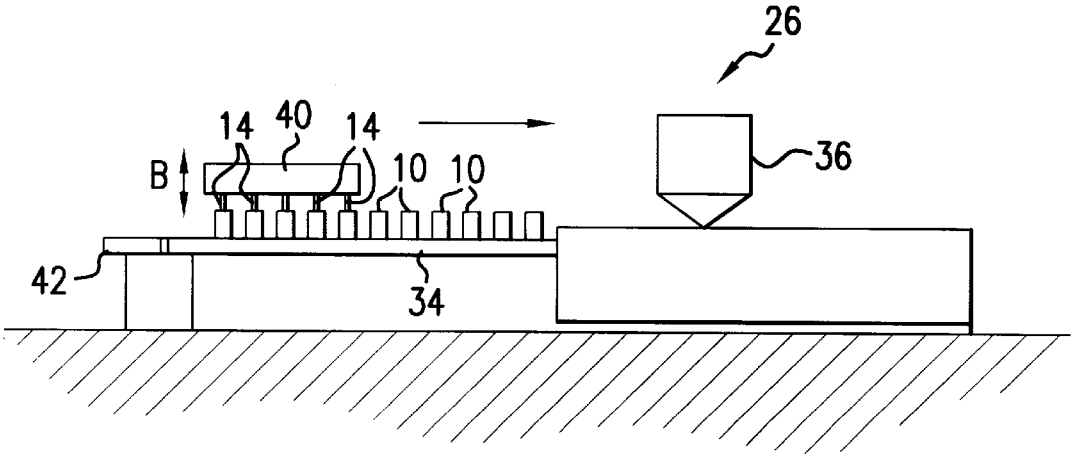
FIG. 5 is an alternative embodiment of an apparatus according to the invention.

Embodiments of an apparatus for triggering an oxygen scavenging component of a container according to the present invention are further described in FIGS. 4 and 5. FIG. 4 illustrates a substantially continuous motion packaging system 26 including a rotatable hub member 28 having a plurality of bulbs 14 arranged extending substantially radially from hub 28 as shown, and driven by any conventional motive means (not shown). A loading station 30 is positioned substantially adjacent to hub 28 with bulbs 14, as is a discharge station 32. Loading station 30 is any suitable container setup and feed structure suitable for feeding containers, open-end first, over bulbs 14 as they are sequentially positioned in alignment with loading station 30. Hub 28 is rotated so as to sequentially advance bulbs 14 from loading station 30 to discharge station 32, where containers 10 are removed from bulbs 14, in this embodiment by gravity. During the course of rotation of hub 28, each bulb 14 is preferably sequentially activated after passing from loading station 30 so as to expose a container 10 positioned thereon to a triggering dose of actinic radiation so as to provide a triggered container including a triggered internal oxygen scavenging component. Triggered containers 10 are unloaded at discharge station 32, and preferably placed on a conveyor or other suitable feeding means 34 for feeding triggered containers to a filling/sealing machine 36 for filling triggered containers 10 with oxygen sensitive material, and sealing same so as to provide a sealed container defining an internal space for containing the oxygen sensitive material, and having a triggered internal oxygen scavenging component for scavenging oxygen from the internal space. Hub 28 is preferably provided with a suitable number of radially extending bulbs 14, depending upon the speed of rotation of hub 28, the desired exposure time of containers 10 on bulbs 14 and various other parameters of the packaging process. Hub 28 may suitably be mounted for rotation in the direction of arrow A, preferably around a substantially horizontal axis so that gravity assists in the removal of triggered containers 10 at discharge station 32. Loading station 30 is preferably any suitable structure for serially arranging and feeding containers 10 to a bulb 14 positioned at loading station 30. Loading station 30 may comprise an automated structure for properly arranging, opening, orienting and otherwise positioning containers with respect to bulbs 14 as desired. Alternatively, containers 10 could be fed to, positioned on or otherwise placed with respect to bulbs 14 manually or through any other means known to one of ordinary skill in the art. Filling/sealing machine 36 may suitably be any conventional apparatus for filling and sealing an open container 10 as desired. It is preferable that bulbs 14 be activated only in the course of their travel from loading station 30 to discharge station 32. A control member 38 is operatively associated with hub 28 for activating bulbs 14 when they pass loading station 30, and for deactivating bulbs 14 upon completion of a desired exposure time, or upon reaching discharge station 32, as desired. The apparatus 26 of FIG. 4 may suitably be used to continuously feed containers to bulbs 14 for triggering, and for continuously feeding triggered containers 10 to filling/sealing machine 36 so as to continuously provide containers containing oxygen sensitive materials and an activated oxygen scavenging component. Apparatus 26 provides an efficient and effective manner of triggering containers.

In FIG. 5, bulbs 14 are arranged in a substantially parallel array, depending downwardly from a base member 40. Base member 40 is vertically positionable as indicated by arrow B in a direction substantially perpendicular to the array of bulbs 14, so as to position bulbs 14 toward and away from conveyor 34 for supporting containers 10 to be triggered. An in-feed conveyor 42 is provided for positioning a plurality of containers 10 on conveyor 34 substantially adjacent to and aligned with bulbs 14. In operation, a plurality of containers 10 are positioned beneath base 40 while base 40 is in an elevated position. Once containers 10 are in the proper position, base 40 is downwardly positioned so as to insert bulbs 14 into containers 10, and the internal space of containers 10 including the oxygen scavenging component are exposed to the desired dose of actinic radiation. After the oxygen scavenging components of containers 10 have been exposed to actinic radiation for the desired amount of time, base member 40 is again elevated so as to remove bulbs 14 from containers 10, and conveyor 34 is advanced so as to feed triggered containers 10 to filling/sealing machine 36, and in-feed conveyor 42 advances a new batch of containers 10 into position beneath bulbs 14 for triggering. Containers 10 are triggered in an intermittent motion, wherein a plurality of containers are triggered in each exposing step.

Alternatively, the containers can be raised to interact with a stationary array of bulbs 14, and after the oxygen scavenging components of containers 10 have been exposed to actinic radiation for the desired amount of time, the containers can be lowered and advanced to filling/sealing machine 36.

Apparatus 26 can readily be adapted to operation upstream and in-line with conventional container filling/sealing equipment. This allows containers 10 to be triggered immediately prior to filling and sealing so that activated containers do not need to be kept in inventory, and further eliminates any separate procedures which may be required prior to the combined triggering and filling/sealing steps. By exposing the internal oxygen scavenging component of containers to radiation from an internally positioned source of actinic radiation, the oxygen scavenging component is exposed to a substantially uniform dose of actinic radiation and is therefore triggered or initiated substantially consistently.

The following example demonstrates the suitable triggering of oxygen scavenging material through exposure to actinic radiation.

EXAMPLE 1

An oxygen scavenging material comprising a three-layer oxygen scavenging film was prepared by a flat coextrusion process. The outer layers of the film contained LLDPE (Dowlex® 3010 from Dow), and the inner oxygen scavenging layer (OSL) contained 68% 1,2-polybutadiene (RB830, JSR (Japan Synthetic Rubber)), 12% EPDM rubber (Vistalon 3708, Exxon), and 20% of an EVA-9 (ethylene/vinyl acetate copolymer, Exxon) based cobalt neodecanoate and benzophenone masterbatch, which had been prepared previously in a twin screw extruder. The final concentration of cobalt in the scavenging layer of the film was about 540 ppm as cobalt metal, and the final concentration of benzophenone was about 0.5%. The total thickness of the film was about 3 mils, with each layer being about 1 mil thick. Portions of film (200 $cm^2$) were irradiated as described below in Table 1 with a UVP Inc. model XX-15S germicidal lamp. The output of the lamp was measured at a distance of 2 cm with an International Light model 1400A radiometer equipped with a SEL 240 detector, a 254 nm narrow band pass filter (NS254), W diffuser, and a neutral density filter (QNDS2). After a 5 minute warm up period, the output ranged from 4.2–5.7 $mW/cm^2$ at 254 nm. Irradiated films were then sealed in barrier bags (BDF 2001 from W. R. Grace) and inflated with 300 cc of air. Portions of the headspace were periodically withdrawn and analyzed for oxygen with a Mocon LC 700F oxygen analyzer. The resulting scavenging data is summarized below in Table 1. The average rate is calculated by considering only the end points, with the following formula: Average Rate=cc $O_2$ scavenged/($m^2$·day) and in this example was calculated after 30 days. The peak instantaneous rate is the highest scavenging rate observed during any sampling period, and is given by: D cc $O_2$ scavenged/($m^2$·Dday), where D is the incremental change. The number in parenthesis is the number of days after triggering required to reach the peak rate. It can be seen that this type of germicidal lamp can successfully trigger oxygen scavenging film.

TABLE 1

Low Intensity Germicidal UV (254 nm) Triggering LLDPE/OSL/LLDPE films at room temperature

| DOSE ($J/cm^2$) | Irradiation Time (seconds) | Induction Period (days) | Average Rate (cc $O_2/m^2$/day) | Peak Ins. Rate (cc $O_2/m^2$/day) |
|---|---|---|---|---|
| 0.26–0.36 | 63 | >1<2 | 50 | 134 (3) |
| 0.63–0.86 | 150 | <1 | 40 | 134 (3) |
| 1.3–1.8 | 310 | <1 | 40 | 206 (2) |
| 2.7–3.6 | 630 | <1 | 44 | 190 (2) |

EXAMPLE 2

The feasibility of triggering rigid or semi-rigid preformed containers was demonstrated. A U-shaped germicidal UV lamp was used to trigger oxygen scavenging film in simulated containers of 3 and 6 inch diameters.

A bench-top triggering unit was fabricated employing U-shaped germicidal lamps (G18T6L/U), ballast, and connector obtained from Atlantic Ultra-Violet/Hauppauge, N.Y. Containers were simulated with test cylinders made from 20 cm lengths of PVC pipe, in 7.6 cm and 15.2 cm diameters. A three layer film having a first layer of EVA, a second layer of a blend of 90% styrene/butadiene copolymer and 10% of a masterbatch comprising 73.35% EVA, 15% Allied AC-400A EVA powder, 1% benzoylbiphenyl, and 10.65% cobalt oleate, and a third layer of linear low density polyethylene, was used as the oxygen scavenging test film and was taped to the inside of the test cylinders. The test cylinders were then centered around the vertical U-shaped UV lamp. Due to the geometry of the lamp, triggering was done along two axes.

Radiometry was done with an IL1400A UV meter (International Light, Inc., Newburyport, Mass.) and an SEL240 detector (W diffuser, NS254 filter, QNDS2 attenuator) was used to measure UV intensity at 254 nm. The detector was mounted at a fixed height (18.5 cm) on an A205 Optical Bench Post (International Light, Inc., Newburyport, Mass.). A measurement grid was laid out to aid in positioning the radiometer detector along both axes of the lamp. A standard Headspace Scavenging Test (HST) was conducted. Headspace oxygen was analyzed on a Mocon LC-700F. Samples were stored at 22° C. in the dark. Rates were calculated after four days storage. Scavenging results are summarized in Table 2. It can be seen that the films have consistent oxygen scavenging properties, regardless of location within the test cylinder.

TABLE 2

ROOM TEMPERATURE SCAVENGING OF OXYGEN SCAVENGING FILM TRIGGERED ON VERTICAL U-SHAPED UV LAMP

| UV TMT(b) | LAMP AXIS(c) | AVERAGE RATE(a) (CC/$M^2$/DAY) MEAN | ST. DEV. | INDUCTION PERIOD (DAY) |
|---|---|---|---|---|
| 3" 60 sec | X | 44.4 | 1.8 | <1 |
| 3" 60 sec | Y | 43.3 | 3.6 | <1 |
| 6" 120 sec | X | 50.9 | 4.3 | <1 |
| 6" 120 sec | Y | 53.2 | 1.8 | <1 |

(a) average rate after 4 days.
(b) 3 or 6 in. diameter PVC test cylinders.

It is to be understood that the invention is not limited to the illustrations described herein.

What is claimed is:

1. A method for packaging an oxygen sensitive material, comprising:

providing containers each defining an internal space and having an internal oxygen scavenging component comprising an oxidizable organic compound;

positioning a source of actinic radiation in said internal space of said containers;

exposing said oxygen scavenging component to a dose of actinic radiation from said source of actinic radiation so as to provide containers each having an activated oxygen scavenging component; and feeding said containers to means for filling and sealing said containers so as to provide sealed containers wherein said oxygen scavenging component scavenges oxygen from said internal space; wherein said positioning step comprises the steps of providing an array of substantially parallel linear bulbs for emitting said actinic radiation, and positioning said array relative to a plurality of containers so as to position said bulbs in internal spaces of said containers.

2. A method for packaging an oxygen sensitive material, comprising:

providing containers each defining an internal space and having an internal oxygen scavenging component comprising an oxidizable organic compound;

positioning a source of actinic radiation in said internal space of said containers;

exposing said oxygen scavenging component to a dose of actinic radiation from said source of actinic radiation so as to provide containers each having an activated oxygen scavenging component; and feeding said containers to means for filling and sealing said containers so as to provide sealed containers wherein said oxygen scavenging component scavenges oxygen from said internal space; wherein said positioning step comprises the steps of providing a plurality of substantially linear bulbs for emitting said actinic radiation extending radially from a rotatable hub, rotating said hub so as to sequentially position each bulb at a loading station and a discharge station, and loading a container over said bulb at said loading station with said bulb positioned in said internal space, and wherein said exposing step is carried out while advancing said bulb to said discharge station.

3. An apparatus for triggering an oxygen scavenging component of a container defining an internal space for containing an oxygen sensitive material, comprising:

means for emitting actinic radiation sufficient to activate an oxygen scavenging component comprising an oxidizable organic compound;

means for supporting a container relative to said means for emitting; and means for positioning a container defining an internal space and having an oxygen scavenging component relative to said means for emitting so as to position said means for emitting in said internal space of said container, whereby said internal oxygen scavenging component is exposed to a substantially uniform dose of actinic radiation from said means for emitting; wherein said means for emitting comprises at least one substantially linear bulb for emitting said actinic radiation, wherein said means for supporting comprises conveyor means for conveying containers along a path substantially perpendicular to said at least one substantially linear bulb, and wherein said means for positioning comprises means for positioning at least one of said means for emitting and said means for supporting in a direction substantially parallel to said at least one substantially linear bulb so as to position said at least one substantially linear bulb in said internal space of a container supported on said means for supporting.

4. An apparatus for triggering an oxygen scavenging component of a container defining an internal space for containing an oxygen sensitive material, comprising:

means for emitting actinic radiation sufficient to activate an oxygen scavenging component comprising an oxidizable organic compound;

means for supporting a container relative to said means for emitting; and means for positioning a container defining an internal space and having an oxygen scavenging component relative to said means for emitting so as to position said means for emitting in said internal space of said container, whereby said internal oxygen scavenging component is exposed to a substantially uniform dose of actinic radiation from said means for emitting; wherein said means for emitting comprises a plurality of substantially linear bulbs for emitting said actinic radiation, said bulbs being arranged substantially parallel on a support member, and wherein said means for positioning comprises means for moving said support member in a direction substantially parallel to said substantially linear bulbs toward and away from said means for supporting.

5. An apparatus for triggering an oxygen scavenging component of a container defining an internal space for containing an oxygen sensitive material, comprising:

means for emitting actinic radiation sufficient to activate an oxygen scavenging component comprising an oxidizable organic compound; and means for positioning a container defining an internal space and having an oxygen scavenging component relative to said means for emitting so as to position said means for emitting in said internal space of said container, whereby said internal oxygen scavenging component is exposed to a substantially uniform dose of actinic radiation from said means for emitting; wherein said means for emitting comprises a plurality of substantially linear bulbs extending radially from a rotatable hub, and further comprising a loading station for loading a container onto a bulb of said bulbs, and a discharge station for discharging a container from said bulb, said hub being rotatable so as to sequentially position each bulb at said loading station and said discharge station, and wherein said means for positioning comprises means for positioning a container over said bulb with said bulb in said internal space at said loading station.

* * * * *